United States Patent [19]

Persbeck

[11] Patent Number: 4,690,091

[45] Date of Patent: Sep. 1, 1987

[54] SECURING ARRANGEMENT SO EXECUTED AS TO BE TRIPPED ON ACTUATION

[75] Inventor: Sven-Erik Persbeck, Torslanda, Sweden

[73] Assignee: Mats Hermansson, Gothenburg, Sweden

[21] Appl. No.: 840,668

[22] Filed: Mar. 18, 1986

[30] Foreign Application Priority Data

Mar. 18, 1985 [SE] Sweden ..... 8501305

[51] Int. Cl.[4] ..... B63B 9/00

[52] U.S. Cl. ..... 114/221 A; 83/639; 441/7; 441/35

[58] Field of Search ..... 30/180; 441/7, 10, 35; 114/326, 336, 221 A; 244/150; 83/926 B, 639

[56] References Cited

U.S. PATENT DOCUMENTS

| | | | |
|---|---|---|---|
| 3,036,798 | 5/1962 | Martin | 114/221 A |
| 3,193,854 | 7/1965 | Butka | 441/10 |
| 3,817,200 | 6/1974 | Hess et al. | 114/221 A |
| 4,052,922 | 10/1977 | Bub | 83/926 B X |

FOREIGN PATENT DOCUMENTS

| | | | |
|---|---|---|---|
| 609000 | 9/1948 | United Kingdom | 244/150 |

*Primary Examiner*—Douglas D. Watts

[57] ABSTRACT

A securing arrangement so executed as to be tripped for release on actuation for the purpose of changing the state of an attached item of equipment. It is so executed as to secure the equipment by means of a loadable link (8) in a securing position. The equipment can be released by means of a tripping arrangement (36, 37, 42) by breaking the link by the actuation of an actuating arrangement (20, 32) by means of a specific factor such as a change in pressure. The link consists of a device which is capable of being cut through, such as a cable (8). The tripping arrangement comprises a blade (36, 37) provided with an edge so arranged as to be moved by the effect of the force of a tensioned spring (42) into a position in which the cable is cut through. The actuating arrangement (20, 32) is so arranged as to hold the blade in its first position by means of a locking arrangement (26), and as to release the blade so that it will adopt its second position upon actuation by means of said factor.

2 Claims, 4 Drawing Figures

SECURING ARRANGEMENT SO EXECUTED AS TO BE TRIPPED ON ACTUATION

The present invention relates to a securing arrangement so executed as to be tripped on actuation for the purpose of changing the state or of enabling a change in the state of an attached item of equipment and comprising connection devices for the equipment, which is so arranged by means of a loadable link as to hold the equipment in a securing position, and which is so arranged by means of a tripping arrangement by breaking the link as to release the equipment on the pre-determined actuation of an actuating arrangement by means of a specific factor such as a change in pressure.

Equipment for various purposes is available which is held in a position of readiness or in an active position by means of a securing arrangement. By tripping the locking arrangement the equipment can be caused to adopt another position, which means in the first case that it is held actuated or is capable of being activated, and in the second case that it is passivated. Tripping can be effected by various means, for instance through the influence of a physical factor such as pressure or temperature when its value exceeds or falls below a certain limit. The aim of the invention is thus to enable an item of equipment to be brought to a certain state by relatively simple, mechanical means without the application of any servo force, at any rate not of any significant magnitude.

An example of equipment which it may be wished to actuate in the manner described is provided by fire doors and doors in watertight bulkheads which require to be closed once a certain temperature value or once a certain water level has been reached in the vicinity of the door. Another type of equipment to which the present invention is particularly applicable as a securing arrangement, especially in the case of the design described as an illustrative embodiment, is life-rafts, for the purpose of securing them. The 'sjösäkerhetsföreskrifterna' (the Maritime Safety Regulations) stipulate that vessels of a certain size shall be equipped with life-rafts which are lashed to the superstructure of the vessel. In the event of the vessel sinking, the lashing must be released once the life-raft has come beneath the surface of the water, whereupon the life-raft will float to the surface. A securing arrangement for this purpose shall be capable of being loaded with a certain force, which arises in the lashing arrangements, and shall be equipped with a tripping device which, as it reaches a certain depth beneath the surface of the water, will trip the arrangement whilst it is loaded with the aforementioned forces so as to release the lashing.

An arrangement of this kind shall not only contain a robust arrangement for absorbing the aforementioned forces and exhibiting a reliable tripping function. It shall also contain a sensitive actuating mechanism which shall react to the small differences in force which occur when the state changes from normal to critical. In other words, the actual tripping arrangement must on the one hand be so arranged as to absorb large forces, and on the other hand be capable of being actuated by small forces, which poses certain problems.

Trippable securing arrangements for life-rafts are subject to the requirements that they shall be inspected at regular intervals. This involves a not insignificant level of cost. If the manufacturing cost of an arrangement of this kind could be brought down to a sufficiently low level by appropriate design, then it is conceivable that the regular replacement and discarding of the old securing arrangement would result in a lower cost than inspection with the associated testing and, where necessary, reconditioning.

The present invention has as its object to make available a securing arrangement of the kind described which is able to absorb large forces, but for which the necessary tripping force is small in spite of this.

Another object of the invention is to make available an arrangement which is suitable for use in conjunction with life-rafts as described above, for instance, said arrangement being simple and robust at the same time as it exhibits a reliable function.

A further object of the invention is to make available a securing arrangement which is so simple and which can be manufactured with such efficient means that its manufacture can be achieved at a lower cost than that of inspection, testing and, where necessary, reconditioning in those cases in which regular examination is stipulated.

Illustrated in the accompanying drawing is an embodiment of the invention which is described below.

Figure 1:
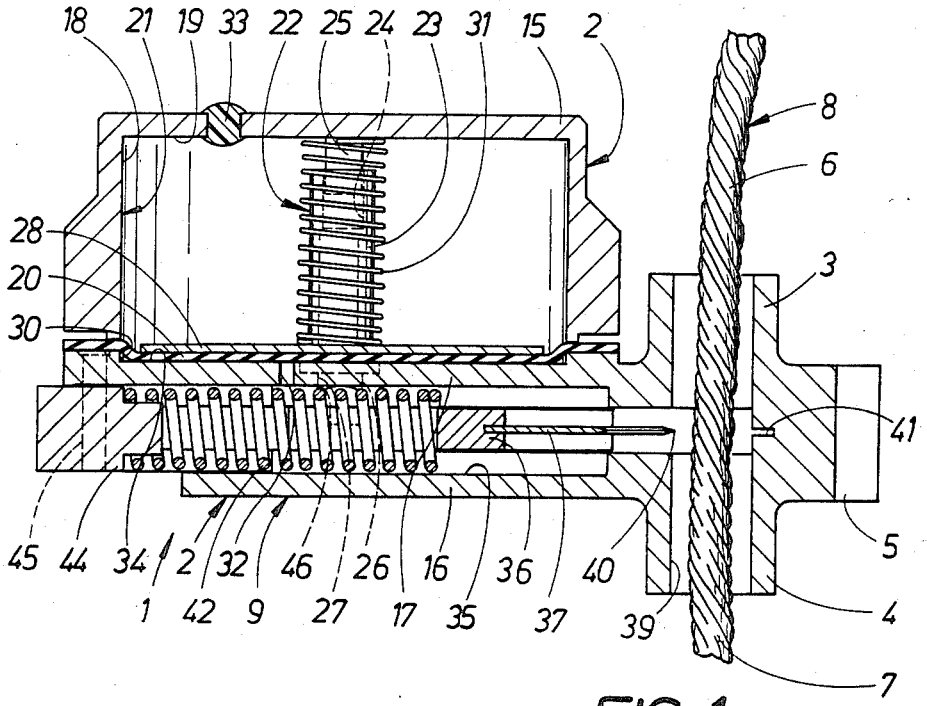
FIG. 1 shows a section through the centre of the arrangement.

According to the Figures the arrangement, which is identified as a whole by the reference designation 1, exhibits an external form consisting of a cylindrical container 2 along the one side of which there extends a longitudinal section 9 with a projecting part 5, from which there extend in both directions and parallel with the axis of the container 2 two cylindrical protrusions 3 and 4. Two sections 6 and 7 of a cable 8 extend outwards from the protrusions 3 and 4 through holes in same.

As will be appreciated from the sectioned view in FIG. 1, the container 2 is in the form of a bowl-shaped component 15 and a bottom component 16, with the actual bottom of the container having the form of a component 17, whilst the rest of the bottom component forms the part 9, the protrusions 3 and 4 and the projecting part 5 in a single piece. The bowl-shaped component 15 exhibits an inner cylindrical wall 18 and a roof 19. A chamber 21 is formed in this way. On the opposite side in relation to the roof 19 the chamber 21 is bounded by a membrane 20 made of a soft, flexible material such as rubber sheeting. There extends through the rubber sheeting a central pin 22, one part 23 of which, situated inside the chamber 21, is provided with a guide 24 which interacts with a guide spindle 25 attached to the roof 19. There extends out from the other side of the membrane 20 a part 26 of the spindle 22, which is introduced through a hole 27 in the aforementioned bottom component 17. The part 23 of the spindle 22 holds a disc 28 made of a rigid material, the edge of which ends at a certain distance from the wall 18.

The membrane 20 is secured along its circular edge by its edge part being clamped between the bowl-shaped component 15 and the bottom component 16 by these components being held together by means of a ring of screws or some other fastening. The bottom component 17 is provided with a recess 30, down into which, as will be appreciated from FIG. 1, the membrane can be flexed by pressure from the plate 28, the diameter of which is smaller than that of the recess. The pressure is provided by means of a coil spring 31 which is tensioned between the plate 28 and the roof 19. The recess 30 forms a chamber 34 on the side of the membrane facing the bottom component 16. This chamber is referred to as the pressure chamber in accordance with the following. The pressure chamber 34 is connected to the surroundings by means of holes 32. The chamber 21, on the other hand, does not have any direct connection with the surroundings. However, in the illustrative embodiment shown here ventilation with a limited through-flow is provided by a plug 33 of Teflon material which extends through the roof 19. This material exhibits the characteristic, for an appropriate pore size, that air is able to flow through it in the presence of a large drop in pressure. The material is not made wet by water, however, which means that a damp environment will not interfere with the air flow.

The spindle 26 extends into an elongated hole 35 in the bottom component 16. The hole 35 is designed to act as a slide for an attachment 36 for a blade 37. The hole 35 is terminated in the direction of the protrusions 3, 4 as a hole 39, which constitutes the aforementioned hole through which the cable 8 extends. The blade attachment 36 can be moved forwards and backwards between a position in which the edge 40 of the blade 37 is situated outside the area of the hole 39 and a position in which the edge of the blade has passed through the hole 39 and into a slot 41 in its wall. The blade attachment 36 is caused to move in a direction towards the last-mentioned position by a compression spring 42 which extends into the hole 35 and makes contact not only with the blade attachment 36, but also with an end piece 44 which is secured directly in line with the hole 35 by dowels 45 or some other means of attachment.

The blade attachment 36 and thus the knife 37 can be secured in the first position outside the area of the hole 39, in which position the spring 42 is under the greatest tension, by the part 26 of the central spindle 22 of the membrane in the position shown in FIG. 1 extending into a hole 46 in the blade attachment 36. As will be appreciated from the Figure, the spring 31 attempts to retain the part 26 of the spindle in the locking hole 46.

Figure 3:
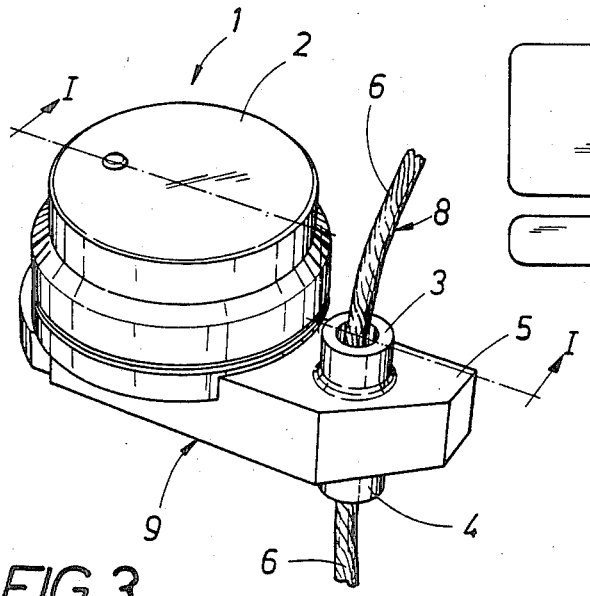
FIG. 3 shows a perspective external view of the arrangement.
Figure 2:
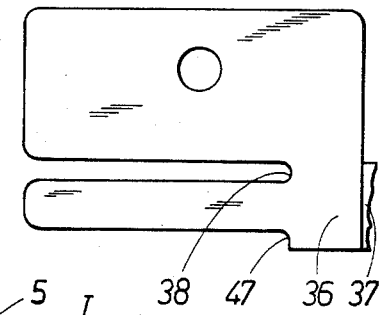
FIG. 2 shows a view of a part of the arrangement.
Figure 4:
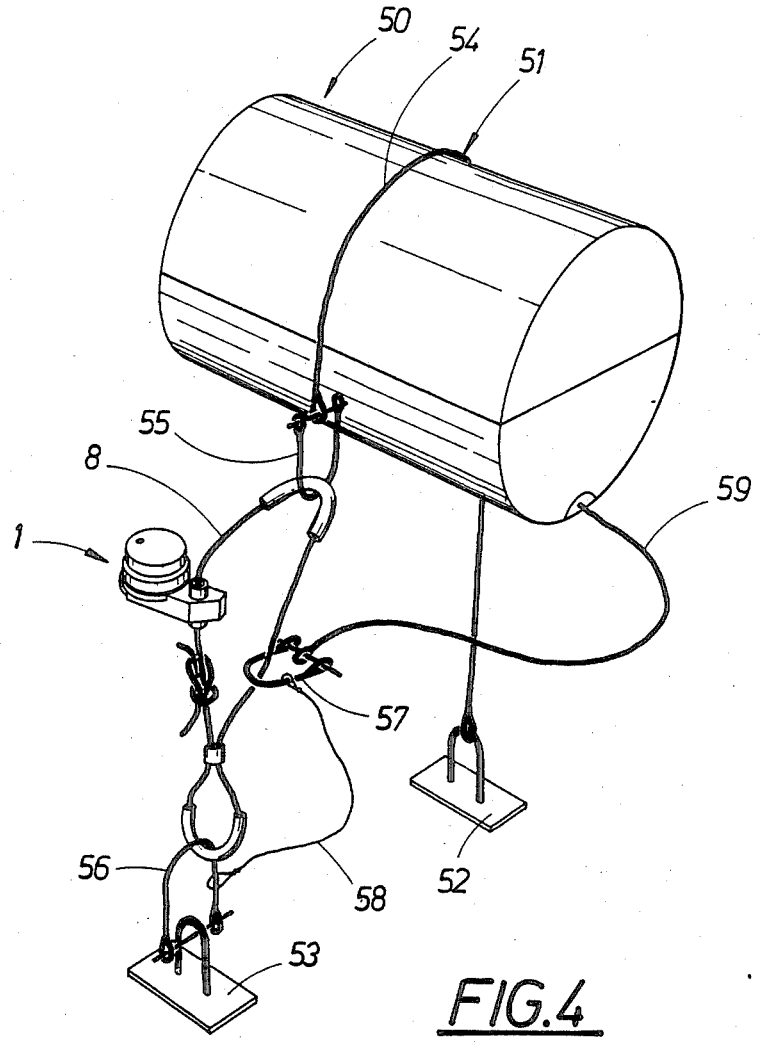
FIG. 4 shows a diagrammatic view of the arrangement installed ready for use in conjunction with life-rafts.

The blade attachment 36 is shown separately in FIG. 2. Because the hole for the cable 8 and the centre of the bowl-shaped component 15 in accordance with FIG. 3 are off-set, the hole 27 for the spindle 26 and the blade 37 will also be off-set. This is also true of the spring 42, which rests against the edges 38 and 47 on both sides of the tongue shown on the blade attachment.

The position illustrated in FIG. 1 constitutes the untripped position of the arrangement in which the arrangement can execute its securing function. The cable 8 is used for securing purposes in this case. If it is assumed that the arrangement is to be used for holding a life-raft 50, securing will be achieved by a cable 51 extending around the raft and to the attachments 52, 53 on the vessel. (It is assumed that the raft 50 is resting in a cradle or similar, and that the attachments 52, 53 are secured to the deck of the vessel or to the superstructure of the vessel). The cable which extends around the raft consists of a cable 54 which runs from the attachment 52 and a sling which consists of the cable 8. The sling consisting of the cable 8 is secured to the cable 54 and to the attachment 53 by means of a cable link 55 and 56. A similar cable link 57 holds together a thin cable 58 and a tripping cable 59. The cable 58 extends in turn between the links 57 and 56 and is secured in this way to the attachment 53. The cable 58 is described as being a thin cable, and the other cables are thus thicker and are designed to withstand the stresses which arise, whereas the cable 58 is a so-called 'weak link' intended to break in a certain situation, as indicated below. At least the cable 55 is so arranged as to be capable of being released manually. The tripping cable 59 is attached to the raft and to a valve in same which opens a gas cylinder so that the inflatable float is filled.

In the event of the vessel to which the raft is attached sinking without anyone having succeeded in releasing the raft manually, the securing arrangement will accompany the vessel below the surface of the water. Water is then able to find its way through the hole 32 and into the pressure chamber 34. The chamber 21, on the other hand, will be closed; as has already been mentioned, the plug 33 will not allow any water to enter. The membrane 20 will thus be influenced unilaterally by the water pressure on the side which faces towards the pressure chamber 34. Once the depth of water as the vessel sinks becomes so great that the water pressure overcomes any frictional forces which are present, in particular the frictional forces between the part 26 of the spindle and the walls in the hole 46 through the pressure of the spring 42 and the force exerted by the spring 31 and the air pressure inside the comparatively large chamber 21, the membrane 20 will move to a position further inside the chamber 21. It does not require to be stretched for this purpose, since in its initial position it formed a fold between the edge of the disc 28 and the outer edge of the recess 30. By reversing this fold the membrane is afforded sufficient movement for the part 26 of the spindle to be moved out of the hole 46 in the blade attachment 36. In this way there is no longer anything to prevent the blade attachment 36 together with the blade 37 from being thrown forwards by the compression spring 42 into their second position with the edge 40 of the blade in the slot 41. Since it passes straight through the hole 39, the cable 8 will be cut. The lashing of the raft is released in this way, and the raft will float to the surface because it exhibits a certain buoyancy.

The lashing is, however, executed in such a way that the tripping cable 59 will be retained on the vessel by means of the thin cable 58. As has already been mentioned, the cable 59 will in this case trip the gas filling arrangement, and the raft will be filled and will achieve full buoyancy. Once the cable has been extended, the buoyancy of the raft will cause it to pull off the thin cable 58, and the raft will then be fully released from the vessel.

If the life-raft is to be released manually, whilst the vessel is still afloat, the link 55, which may be executed in the form of a shackle, for example, is opened. The raft can now be thrown into the water. The cable 59 is secured in this case, too, but by means of the sling consisting of the cable 8 without imposing a strain on the thin cable 58. The filling of the raft with gas is tripped in this way, although it is prevented from floating away from the vessel because it is secured to the attachment 53 via the cable 59 and the sling consisting of the cable 8. If, however, the vessel were to sink before the raft had been successfully released, which can take place, for example, by opening the link 57, the securing arrangement 1 will be tripped and the sling consisting of the cable 8 will be opened, so that a strain is imposed on the thin cable 58. As will have already been appreciated, this is so dimensioned that it will rupture, so that the raft cannot be taken down with the vessel.

During the period for which the arrangement executes its securing function on a vessel, it is exposed to varying weather conditions and varying temperatures. If the chamber 21 were to be entirely closed, this would give rise to varying air pressure inside it. This would mean that a negative pressure effect could be produced on the side of the membrane 20 facing the chamber 21, which could, under the most unfavourable circumstances, cause the arrangement to trip. This is prevented, however, by the fact that pressure equalization is able to take place slowly via the material of the plug 33. As has already been mentioned, the plug will not allow water to pass through it, for which reason water pressure can never occur on both sides of the membrane.

The arrangement can be manufactured in an efficient fashion essentially in plastic. It does not require any precision components, and it is not fitted with a sensitive locking mechanism. It is accordingly capable of being manufactured at such a low price that it can be replaced in a maritime context at a lower cost than that for inspection, testing and reconditioning.

The arrangement has been illustrated and described as being suitable for securing life-rafts and for their release as a result of increasing water pressure. It is, however, possible within the scope of the following Patent Claims to execute the arrangement for other purposes, too, without departing from the idea of invention. It can thus be applied to pipework systems for the tripping of one or other function in the event of changes in pressure beyond a certain limit. In this case the chamber 34 can be used to provide positive pressure, or the chamber 21 can be used for monitoring negative pressure. Units of physical influence other than pressure can also be utilized to trip the arrangement, for example temperature by the use of bimetal strips or pressure transducers. The arrangement can also be executed for manual tripping. In this case the lock for the knife can be tripped mechanically, pneumatically, hydraulically or electrically.

I claim:

1. Securing device connected to a loadable link for attaching an item of equipment to a construction, the device being operable to open the link to release the equipment by being actuated by a change in pressure in the water surrounding the device, which device comprises a channel for the link, which link is in the form of a cable, guide means transverse to the channel, blade means having a sharp edge slidable in the guide means between a first position adjacent to the channel and a second position across the channel, spring means for moving the blade means from its first to its second position, locking means having a locked position for holding the blade means in its first position and an unlocked position for leaving the blade means free to be moved by means of the spring means, a pressure chamber, a movable element in the pressure chamber subject to the influence of the pressure in the chamber, second spring means for pressing the element into the chamber with a predetermined force, connecting means between the element and the locking means for holding the locking means in its locked position when the second spring means is biasing the element to be in an inner position in the chamber and for bringing the locking means to its unlocked position in order to release the blade means when the element is pressed outwards from the chamber from its inner position by means of a predetermined pressure level in the chamber, the second spring means being adjustable to allow the element to be moved from its inner position by the reaching of the predetermined pressure level in the chamber.

2. A securing device according to claim 1, for securing a life raft to a ship by means of said cable, in which said movable element comprises a membrane extending across said chamber, an area below said element having an open connection to let in water, so that the element is influenced by the pressure of the water on the side thereof facing said area, an area above said element having a connection with the surrounding water and having a flow restriction in the form of a filter, said area above said element comprising a second chamber containing air of atmospheric pressure.

* * * * *